US012055075B1

(12) United States Patent
Alexandru et al.

(10) Patent No.: US 12,055,075 B1
(45) Date of Patent: Aug. 6, 2024

(54) VALVE ACTUATION SYSTEM COMPRISING ROCKER ASSEMBLIES SHARING AN OUTPUT ROCKER

(71) Applicant: Jacobs Vehicle Systems, Inc., Bloomfield, CT (US)

(72) Inventors: Matei Alexandru, Simsbury, CT (US); Tyler Hines, Stafford Springs, CT (US); Gabriel S. Roberts, Wallingford, CT (US); Austen P. Metsack, Ashford, CT (US)

(73) Assignee: JACOBS VEHICLE SYSTEMS, INC., Bloomfield, CT (US)

( * ) Notice: Subject to any disclaimer, the term of this patent is extended or adjusted under 35 U.S.C. 154(b) by 0 days.

(21) Appl. No.: 18/542,631

(22) Filed: Dec. 16, 2023

Related U.S. Application Data

(60) Provisional application No. 63/387,945, filed on Dec. 17, 2022.

(51) Int. Cl.
*F01L 13/00* (2006.01)
*F01L 1/18* (2006.01)
(Continued)

(52) U.S. Cl.
CPC ..... *F01L 13/0036* (2013.01); *F01L 1/181* (2013.01); *F01L 1/267* (2013.01); *F01L 1/46* (2013.01);
(Continued)

(58) Field of Classification Search
CPC ... F01L 1/181; F01L 2001/186; F01L 1/2411; F01L 1/267; F01L 1/46; F01L 2001/467; F01L 13/0036
(Continued)

(56) References Cited

U.S. PATENT DOCUMENTS

2016/0230679 A1* 8/2016 Haga ..... F02D 41/123
2018/0045083 A1* 2/2018 Sugiura ..... F01L 1/20
2020/0182103 A1* 6/2020 Mandell ..... F01L 1/24

FOREIGN PATENT DOCUMENTS

JP 2005233031 A 9/2005
WO 2008010900 A2 1/2008
(Continued)

OTHER PUBLICATIONS

International Search Report for International application No. PCT/IB2023/062838, mailed on Mar. 26, 2024, 3 pages.
(Continued)

*Primary Examiner* — Jorge L Leon, Jr.
(74) *Attorney, Agent, or Firm* — Jordan IP Law, LLC

(57) ABSTRACT

A system for actuating at least one engine valve comprises an output rocker operatively connected to the at least one engine valve. A first rocker assembly is operatively connected to a first valve actuation motion source. The first rocker assembly comprises a first input rocker arranged in series with a first lost motion component, wherein the first input receives first valve actuation motions from the first valve actuation motion source and the first lost motion component is operatively connected to the output rocker. A second rocker assembly is operatively connected to a second valve actuation motion source. The second rocker assembly comprises a second input rocker arranged in series with a second lost motion component, wherein the second input rocker receives second valve actuation motions from the second valve actuation motion source and the second lost motion component is operatively connected to the output rocker.

14 Claims, 7 Drawing Sheets

(51) Int. Cl.
*F01L 1/26* (2006.01)
*F01L 1/46* (2006.01)
*F01L 1/24* (2006.01)

(52) U.S. Cl.
CPC ..... *F01L 2001/186* (2013.01); *F01L 1/2411* (2013.01); *F01L 2001/467* (2013.01)

(58) Field of Classification Search
USPC ..... 123/90.39, 90.4, 90.44, 90.46
See application file for complete search history.

(56) References Cited

FOREIGN PATENT DOCUMENTS

| | | | | |
|---|---|---|---|---|
| WO | 2008150457 | A1 | 12/2008 | |
| WO | 2021165919 | A1 | 8/2021 | |
| WO | WO-2023034896 | A1 * | 3/2023 | ..... F01L 1/047 |

OTHER PUBLICATIONS

Written Opinion of the International Searching Authority for International application No. PCT/IB2023/062838, mailed on Mar. 26, 2024, 4 pages.

* cited by examiner

VALVE ACTUATION SYSTEM COMPRISING ROCKER ASSEMBLIES SHARING AN OUTPUT ROCKER

FIELD

The present disclosure generally concerns internal combustion engines and, in particular, valve actuation systems comprising rocker assemblies sharing an output rocker.

BACKGROUND

Valve actuation in an internal combustion engine is required for the engine to operate. Typically, valve actuation forces to open the engine valves (i.e., intake, exhaust or auxiliary engine valves) are conveyed by valve trains where such valve actuation forces may be provided by main and/or auxiliary motion sources. As used herein, the descriptor "main" refers to so-called main event engine valve motions, i.e., valve motions used during positive power generation in which fuel is combusted in an engine cylinder to provide a net output of engine power, whereas the descriptor "auxiliary" refers to other engine valve motions for purposes that are alternative to positive power generation (e.g., compression release braking, bleeder braking, cylinder decompression, cylinder deactivation, brake gas recirculation (BGR), etc.) or in addition to positive power generation (e.g., internal exhaust gas recirculation (IEGR), variable valve actuations (VVA), early exhaust valve opening (EEVO), late intake valve closing (LIVC), swirl control, etc.).

In many internal combustion engines, the main and/or auxiliary motion sources may be provided by fixed profile cams, and more specifically by one or more fixed lobes or bumps which may be an integral part of each of the cams. Benefits such as increased performance, improved fuel economy, lower emissions, and better vehicle drivability may be obtained if the intake and/or exhaust valve timing and lift can be varied. The use of fixed profile cams, however, can make it difficult to adjust the timings and/or amounts of engine valve lift to optimize them for various engine operating conditions.

One method of adjusting valve timing and lift, given a fixed cam profile, has been to provide a "lost motion" or variable length device in the valve train linkage between a given engine valve and its corresponding cam. Lost motion is the term applied to a class of technical solutions for modifying the valve actuation motion defined by a cam profile with a variable length mechanical, hydraulic, or other linkage assembly. In a lost motion system, a cam lobe may provide the "maximum" motion (longest dwell and greatest lift) needed over a full range of engine operating conditions including, as required in some cases, for positive power generation operation and/or auxiliary operation. A variable length system may then be included in the valve train linkage, intermediate of the valve to be opened and the cam providing the maximum motion, to subtract or lose part or all of the motion imparted by the cam to the valve. Typically, such lost motion devices are controllable between a "locked" or motion conveying state and an "unlocked" or motion absorbing state. During the locked stated, the lost motion device is maintained in a substantially rigid configuration (with allowances for lash adjustments) such that valve actuation motions applied thereto are conveyed to the corresponding engine valve(s). On the other hand, during the unlocked state, the lost motion device is permitted to absorb or avoid, i.e., "lose," at least some (up to and including all) of the valve actuation motions applied thereto, thereby preventing such valve actuation motions from being conveyed to the corresponding engine valve(s).

Valve actuation systems incorporating lost motion capability continue to be developed to provide ever greater valve actuation functionality and flexibility. However, increased cost, packaging, and size are factors that may often determine the desirability of such engine valve actuation systems. Valve actuation systems comprising lost motions components that overcome these limitations while still providing varied valve actuation functionality and flexibility would represent a welcome advancement of the art.

SUMMARY

The instant disclosure describes various embodiments of a valve actuation system for actuating at least one engine valve in an internal combustion engine. In an embodiment, a system for actuating at least one engine valve associated with a cylinder of an internal combustion engine comprises an output rocker operatively connected to the at least one engine valve. A first rocker assembly is operatively connected to a first valve actuation motion source. The first rocker assembly comprises a first input rocker arranged in series with a first lost motion component, wherein the first input rocker is configured to receive first valve actuation motions from the first valve actuation motion source and the first lost motion component is operatively connected to the output rocker. The first lost motion component is operable, in a motion absorbing state, to prevent conveyance of the first valve actuation motions from the first input rocker to the output rocker and, in a motion conveying state, to convey the first valve actuation motions from the first input rocker to the output rocker. A second rocker assembly is operatively connected to a second valve actuation motion source. The second rocker assembly comprises a second input rocker arranged in series with a second lost motion component, wherein the second input rocker is configured to receive second valve actuation motions from the second valve actuation motion source and the second lost motion component is operatively connected to the output rocker. The second lost motion component is operable, in a motion absorbing state, to prevent conveyance of the second valve actuation motions from the second input rocker to the output rocker and, in a motion conveying state, to convey the second valve actuation motions from the second input rocker to the output rocker.

In an embodiment, the output rocker comprises at least one hydraulic lash adjuster.

In an embodiment, at least two engine valves are associated with the cylinder and the output rocker is operatively connected to the at least two engine valves. Further to this embodiment, a valve bridge may be disposed between and operatively connected to the output rocker and to the at least two engine valves.

In an embodiment, the first rocker assembly and the output rocker are configured to operate as a Type II rocker. Further to this embodiment, each of the output rocker and the first input rocker may comprise a shaft-mounted Type III rocker. Furthermore, the second rocker assembly and the output rocker may be configured to operate as a Type II rocker, and each of the output rocker and the second input rocker may comprise a shaft-mounted Type III rocker.

In an embodiment, the output rocker comprises at least two arms, and a first arm and a second arm of the output rocker define a first central opening configured to receive the first input rocker between the first and second arms. Further to this embodiment, the output rocker may comprise a third arm, wherein the second arm and third arm define a second central opening configured to receive the second input rocker between the second and third arms.

In an embodiment, each of the first lost motion component and the second lost motion component comprises a hydraulically controlled locking mechanism.

In an embodiment, the first lost motion component comprises a first spring that biases the first input rocker toward the first valve actuation motion source and biases the output rocker toward the at least one engine valve. Also, in an embodiment, the second lost motion component comprises a second spring that biases the second input rocker toward the second valve actuation motion source and biases the output rocker toward the at least one engine valve.

In an embodiment, the first lost motion component is configured to provide a failsafe lift.

DETAILED DESCRIPTION OF THE PRESENT EMBODIMENTS

As used herein, phrases substantially similar to "at least one of A, B or C" are intended to be interpreted in the disjunctive, i.e., to require A or B or C or any combination thereof unless stated or implied by context otherwise. Further, phrases substantially similar to "at least one of A, B and C" are intended to be interpreted in the conjunctive, i.e., to require at least one of A, at least one of B and at least one of C unless stated or implied by context otherwise. Further still, the term "substantially" or similar words requiring subjective comparison are intended to mean "within manufacturing tolerances" unless stated or implied by context otherwise.

As used herein, the term "operatively connected" is understood to refer to at least a functional relationship between two components, i.e., that the claimed components must be connected (potentially including the presence of intervening elements or components) in a way to perform an indicated function.

Figure 1:
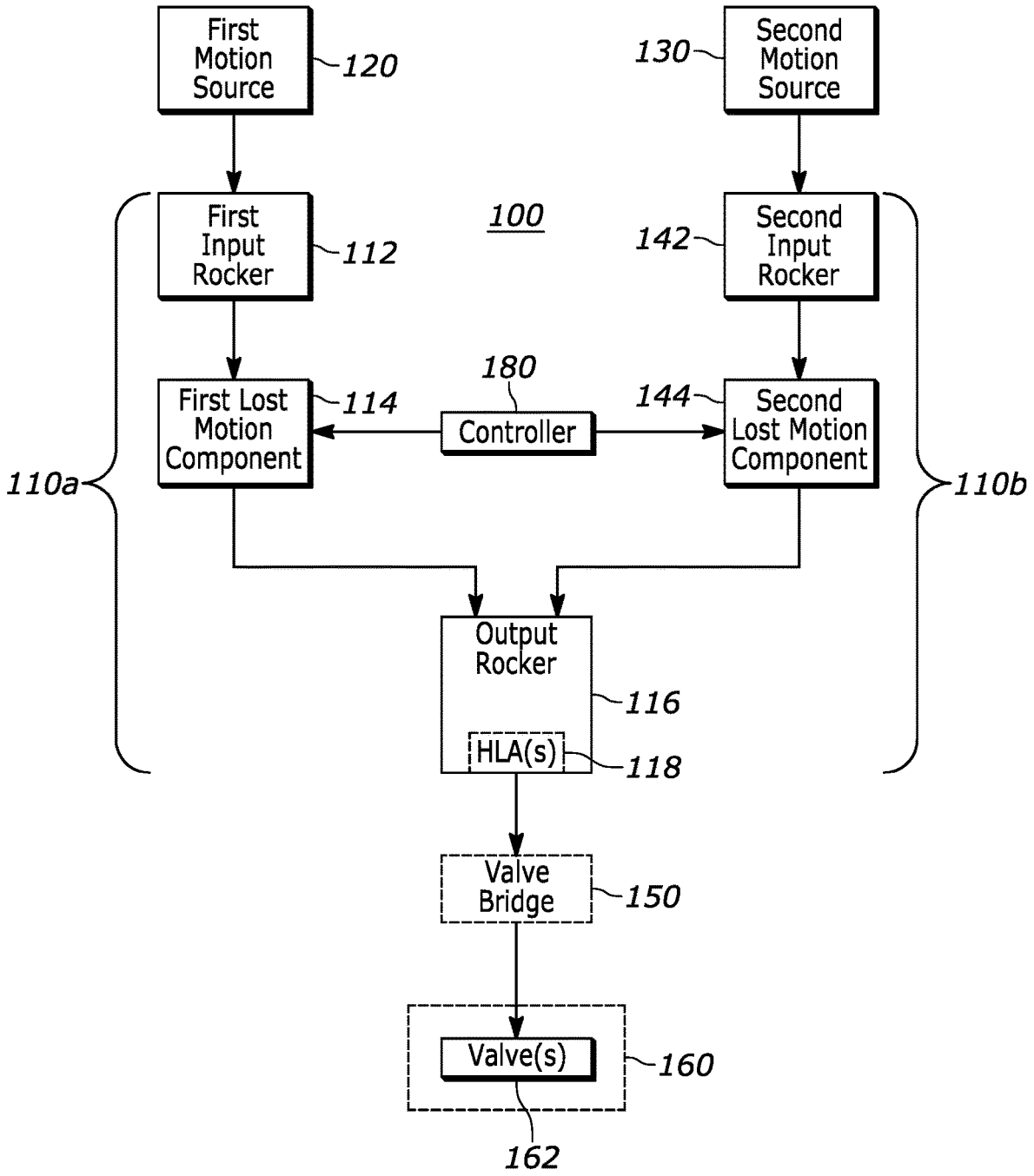
FIG. 1 schematically illustrates an embodiment of a valve actuation system, including a single output rocker, in accordance with the instant disclosure.

FIG. 1 schematically illustrates a valve actuation system 100 comprising a first rocker assembly 110*a* and a second rocker assembly 110*b*. As shown, the first rocker assembly 110*a* is operatively connected to a first valve actuation motion source 120 and the second rocker assembly 110*b* is operatively connected to a second valve actuation motion source 130. One or more engine valves 162 (which may be, for example, intake valves or exhaust valves) are associated with a cylinder 160 of an internal combustion engine, which valves 162 are operatively connected to the first rocker assembly 110*a* and the second rocker assembly 110*b* via a shared or common output rocker 116 as a constituent element of both the first rocker assembly 110*a* and the second rocker assembly 110*b*. In this manner, the first and second rocker assemblies 110*a*, 110*b* operate to actuate (i.e., open and close) the engine valve(s) 162 as commanded by the first and second valve actuation motion sources 120, 130, subject to operation of any incorporated lost motion components as described in further detail below. Although only a single cylinder 160 is illustrated in FIG. 1, it is appreciated that an internal combustion engine may comprise more than one cylinder and the valve actuation systems described herein may be applied to any number of cylinders for a given internal combustion engine.

The valve actuation motion sources 120, 130 may comprise any combination of elements capable of providing valve actuation motions, such as a cam. Each of the valve actuation motion sources 120, 130 may be dedicated to providing main exhaust motions, main intake motions, auxiliary motions or a combination of main exhaust or main intake motions together with auxiliary motions. For example, in one embodiment, the first motion source 120 is configured to provide auxiliary valve actuation motions and the second motion source 130 is configured to provide main valve actuation motions (either exhaust or intake).

The first rocker assembly 110*a* comprises a first input rocker 112, a first lost motion component 114 and the output rocker 116 arranged in series. As used herein, the phrase "in series" is with reference to conveyance of valve actuation motions, i.e., components are in series at least to the extent that they convey valve actuation motions from one to the other along a path from a valve actuation motion source to one or more engine valves. In particular, the first input rocker 112 is operatively connected to the first valve actuation motion source 120 and the output rocker 116 is operatively connected to the engine valve(s) 162, with the first lost motion component 114 operatively connected to and deployed between the first input rocker 112 and the output rocker 116. The first input rocker 112 and the output rocker 116 may comprise center pivoting or Type III rocker arms and various implementations based on center pivoting rocker arms are described in further detail below. It is appreciated, however, that the first input and output rockers 112, 116 may also be implemented using end pivoting or Type II rocker arms. Optionally (as indicated by the dashed lines), one or more hydraulic lash adjusters (HLA) 118 may be included in the output rocker 116, which may include hydraulic passages (as known in the art; not shown) suitable for providing hydraulic fluid to the HLA(s) 118. It is appreciated that the HLA(s) 118 may instead be deployed as part of the other components 112, 114, 142, 144 constituting the first rocker assembly 110*a* and/or second rocker assembly 110*b*.

The second rocker assembly 110*b* comprises a second input rocker 142, a second lost motion component 144 and an output rocker 116 arranged in series. In particular, the second input rocker 142 is operatively connected to the second valve actuation motion source 130 and, as before, the output rocker 116 is operatively connected to the engine valve(s) 162, with the second lost motion component 144 operatively connected to and deployed between the second input rocker 142 and the output rocker 116. Once again, the second input rocker 142 and the output rocker 116 may comprise center pivoting or Type III rocker arms and various implementations based on center pivoting rocker arms are described in further detail below.

A feature of the instant disclosure is that the output rocker 116 shared by the first and second rocker assemblies 110*a*,

110*b* may be used to actuate a single engine valve or multiple engine valves as commanded by either or both or neither of the first and second motion sources 120, 130. In the case of a single engine valve 162, the output rocker 116 may be operatively connected to the single engine valve 162, possibly via the HLA 118 or other connecting assembly (such as a lash adjustment screw and swivel as known in the art). In the case of multiple engine valves 162, the output rocker 116 may be operatively connected to the engine valves 162 as in the case of a single engine valve and, again, possibly via multiple HLAs 118 (one for each engine valve 162) or connecting assembly. Optionally, in the case of multiple engine valves 162 and as shown in FIG. 1, a valve bridge 150, as known in the art, may be deployed between a single output point of the output rocker 116 and the multiple engine valves 162.

As further depicted in FIG. 1, an engine controller 180 may be provided and operatively connected to the first and second lost motion components 114, 144. The engine controller 120 may comprise any electronic, mechanical, hydraulic, electrohydraulic, or other type of control device for controlling operation of the first and second lost motion components 114, 144, i.e., switching between their respective locked and unlocked states as described above. For example, the engine controller 180 may be implemented by a microprocessor and corresponding memory storing executable instructions used to implement the required control functions, including those described below, as known in the art. It is appreciated that other functionally equivalent implementations of the engine controller 180, e.g., a suitably programmed application specific integrated circuit (ASIC) or the like, may be equally employed. Further, the engine controller 180 may include peripheral devices, intermediate to engine controller 180 and the first and second lost motion components 114, 144, that allow the engine controller 180 to effectuate separate control over the operating state of the first and second lost motion components 114, 144. For example, where the first and second lost motion components 114, 144 are both hydraulically controlled mechanisms (i.e., responsive to the absence or application of hydraulic fluid to an input), such peripheral devices may include suitable solenoids.

As shown in FIG. 1, control of the first and second lost motion components 114, 144 by the engine controller 180 is provided directly thereto. In practice, however, such control may be provided via a path through at least one of the adjoining input rockers 112, 142 or the output rocker 116. For example, in the various embodiments described herein, such control is provided through the use of hydraulic fluid supplied via one or more fluid passages respectively formed in the first and second input rockers 112, 142 under the control of the engine controller 180. However, as will be appreciated by those having skill in the art, other types of control schemes may be equally employed for this purpose.

Configured as shown in FIG. 1, the valve actuation system 100 provides various options for actuating the engine valve (s) 162. For example, where the second valve actuation motion source 130 provides main valve actuation motions and the first valve actuation motion source 120 provides auxiliary valve actuation motions, the first lost motion component 114 can be controlled to be in its unlocked or motion absorbing state such that auxiliary valve actuation motions applied to the first input rocker 112 are not conveyed by the first lost motion component 114 to the output rocker 116 or, consequently, the engine valve(s) 162. Additionally, the second lost motion component 144 can be controlled to also be in its unlocked or motion absorbing state such that main valve actuation motions applied to the second input rocker 142 are not conveyed by the second lost motion component 144 to the output rocker 116 or, consequently, the engine valve(s) 162. Such control of the engine valves 162, 164 can be used, for example, to implement cylinder deactivation (CDA) operation of the engine.

Alternatively, based on this same example, where the first lost motion component 114 is once again operated in its unlocked/motion absorbing state and the second lost motion component 144 is operated in its locked/motion conveying state, the auxiliary valve actuation motions will not be conveyed to the engine valve(s) 162 whereas the main valve actuation motions will be conveyed to the engine valve(s) 162. Such control of the engine valve(s) 162 can be used, for example, to implement positive power generation operation of the engine.

In another alternative, based on this same example, where the first lost motion component 114 is operated in its locked/motion conveying state and the second lost motion component 144 is operated in its locked/motion conveying state, both the main and auxiliary valve actuation motions will be conveyed to the engine valve(s) 162. Such control of the engine valves 162, 164 can be used to implement, for example, conventional 4-stroke, compression-release engine braking operation of the engine, or to provide other, additive auxiliary valve actuation motions of the types noted above.

In yet another alternative, based on this same example, where the first lost motion component 114 is operated in its locked/motion conveying state and the second lost motion component 144 is operated in its unlocked/motion absorbing state, the auxiliary valve actuation motions will be conveyed to the engine valve(s) 162 whereas the main valve actuation motions will not be conveyed to the engine valve(s) 162. Such control of the engine valve(s) 162 can be used to implement operating modes in which auxiliary valve actuations, but not main valve actuations are desired. For example, such operating modes may include so-called 2-stroke or 1.5-stroke, compression-release engine braking operation of the engine.

Figure 2:
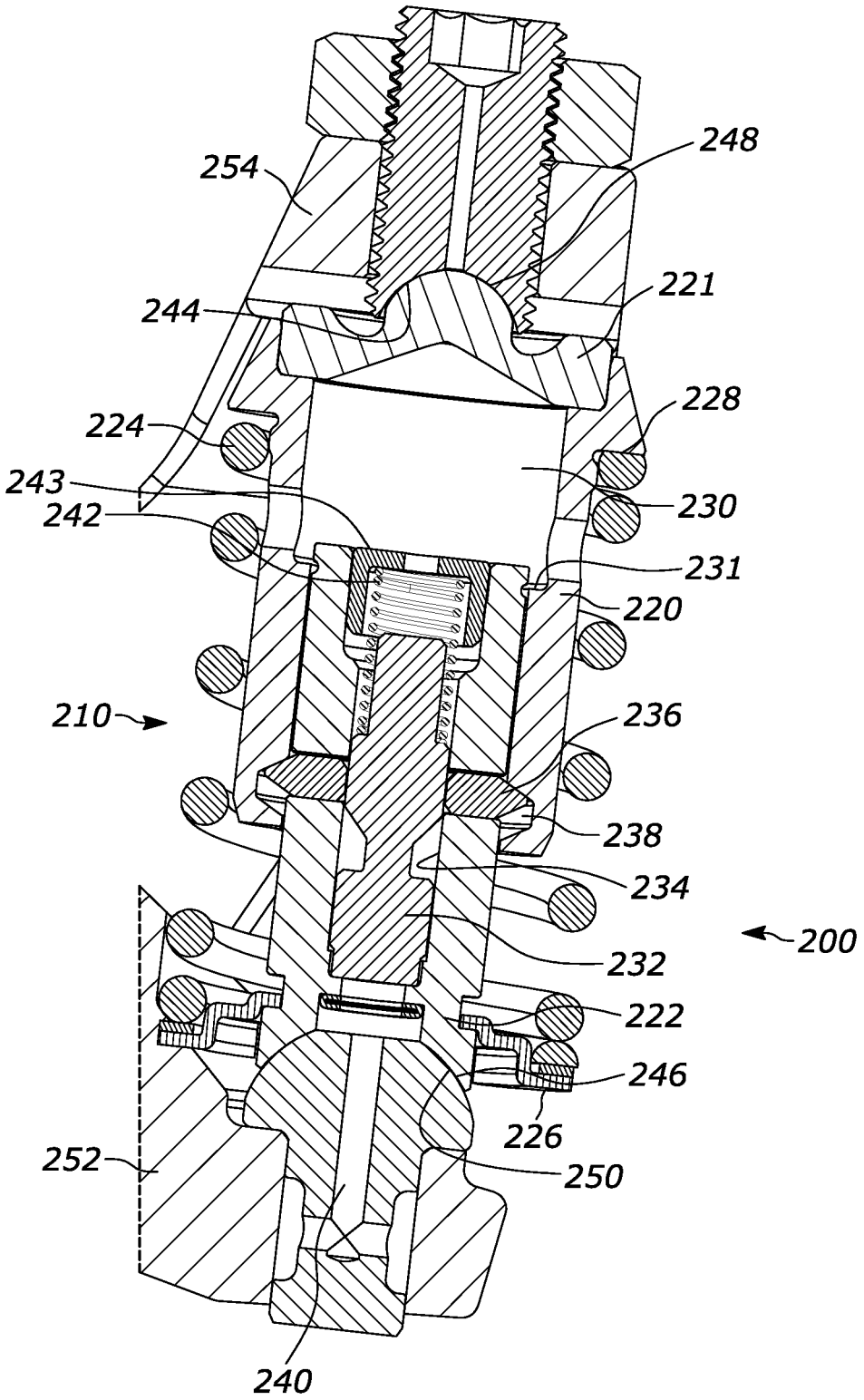
FIG. 2 is a cross-sectional illustration of an example of a lost motion component that may be used to implement the various embodiments described herein.

FIG. 2 illustrates an example of a lost motion component 200 that may be used in conjunction with the valve actuation system 100 illustrated in FIG. 1, as well as the various specific implementations described below relative to FIGS. 3-6. The lost motion component 200 is depicted in cross section, thereby better illustrating a hydraulically controlled locking mechanism 210, constituting a subassembly of the lost motion component 200 and deployed between a housing 220 and a plunger 222. Although the housing 220 may be formed as a unitary element, in the example illustrated in FIG. 2, a closed end of the housing 220 is provided by with an end cap 221 attached to the housing 220. A plunger spring 224 is deployed outside of the housing 220 and plunger 222. In the illustrated embodiment, the plunger spring 224 is deployed between a flange 226 formed on or attached to an outer surface of the plunger 222 and a shoulder 228 formed in the housing 220. In this manner, the plunger spring 224 biases the housing 220 and plunger 222 away from each other. In an embodiment, the bias force applied by the plunger spring 224 is sufficiently high so as to prevent extension of any hydraulic lash adjuster deployed within the same valve train as the lost motion component 200. Additionally, while the plunger spring 224 is deployed in the illustrated example as being outside of the housing 220, it is appreciated that the plunger spring 224 could also be disposed within the housing 220 such that it provides similar biasing as described above.

As noted, the plunger spring 224 is sufficiently strong as to prevent extension of any hydraulic lash adjusters deployed in the same valve train as the lost motion component 200. However, this could lead to collapse of the hydraulic lash adjuster if the bias force of the plunger spring 224 is too strong. To prevent this, stroke limiting may be provided in the lost motion component 200 so as to prevent overextension of the housing 220 and plunger 222 away from each other, which could otherwise place a compressive force on a hydraulic lash adjuster sufficient to cause the hydraulic lash adjuster to collapse. For example, though not shown in FIG. 2, an end of the plunger 222 in proximity to the plunger cap 243 could include a radially extending lip or flange that is configured to engage a shoulder 231 formed in surface defining the housing bore 230. Thus, when the plunger 222 is biased out of the housing 220 by the plunger spring 224, engagement of the radially extending lip or flange with the shoulder 231 prevents further travel of the plunger 222 out of the housing 220. By traveling limiting the plunger 222 in this manner, the lost motion component 200 is prevented from applying excessive compressive force on any constituent hydraulic lash adjuster in the valve train, thereby prevent collapse of the hydraulic lash adjuster.

As shown in FIG. 2, the locking mechanism 210 includes the plunger 222 disposed within a housing bore 230 formed in and extending along a longitudinal axis of the lost motion component 200 from a first end of the housing 220. An inner plunger 232 is slidably disposed in a longitudinal bore 234 formed in the plunger 222. Locking elements in the form of wedges 236 are provided, which wedges are configured to engage with an annular outer recess 238 formed in a surface defining the housing bore 230. The illustrated embodiment is of a normally locked locking mechanism 210, i.e., in the absence of hydraulic control applied to the inner plunger 232 via, in this case, a lost motion hydraulic passage 240, an inner plunger spring 242 biases the inner plunger 232 into position such that the wedges 236 radially extend out of openings formed in the plunger 220, thereby engaging the outer recess 238 and effectively locking the plunger 222 in place relative to the housing 220.

In this locked state, any valve actuation motions (whether main or auxiliary motions) applied to either end of the lost motion component 200 are conveyed by the lost motion component 200. It is noted that, despite being in the locked state as shown in FIG. 2, a longitudinal extent of the outer recess 238 is greater than a thickness of the wedges 236 such that a small amount of movement is nevertheless permitted between the plunger 222 and housing 220. Such additional space provided by the outer recess 238 facilitates locking/unlocking of the locking mechanism 210 when the lost motion component 200 is unloaded. As shown in FIG. 2, this additional space has been taken up as in the case, for example, where a valve actuation motion has been applied to the lost motion component 200 thereby overcoming any outward bias applied by the plunger spring 224 to the plunger 222.

The bias applied by the plunger spring 224 can be selected to additionally ensure that the adjacent valve train components 252, 254 (or such additional up- or downstream valve train components in the system, not shown) are biased into continuous contact with respective endpoints of the valve train, i.e., valve actuation motions sources and engine valves.

Referring again to FIG. 2, provision of hydraulic fluid to the input-receiving end (bottommost surface as shown in FIG. 2) of the inner plunger 232 via the lost motion hydraulic passage 240, sufficiently pressurized to overcome the bias of the inner plunger spring 242, causes the inner plunger 232 to translate within the bore 234 such that the wedges 236 are permitted to retract and disengage from the outer recess 238, thereby effectively unlocking the plunger 222 relative to the housing 220 and permitting the plunger 222 to slide freely within its bore 230, subject, in this case, to the bias provided by the plunger spring 224. In this unlocked state, any valve actuation motions applied to the lost motion component 200 will cause the plunger 222 to reciprocate in its bore 230. In this manner, and presuming travel of the plunger 222 within its bore 230 is greater than the maximum extent of any applied valve actuation motions (i.e., that the plunger 222 is unable to bottom out in its bore 230), such valve actuation motions are not conveyed by the lost motion component 200 and are effectively lost. Alternatively, travel of the plunger 222 within its bore 230 could be configured such that the plunger 222 "bottoms out," i.e., makes contact with the closed end of the bore 230, so as to always provide a "failsafe" valve lift in the event of a failure of the locking mechanism 210.

Although FIG. 2 illustrates a particular embodiment and configuration of a lost motion component 200, it is understood that other configurations may be equally employed and the instant disclosure is not limited in this regard. For example, as noted previously, the illustrated lost motion component 200 is a normally locked lost motion component. However, as will be appreciated by those skilled in the art, normally unlocked types of lost motion components may be equally employed.

Figure 2A:
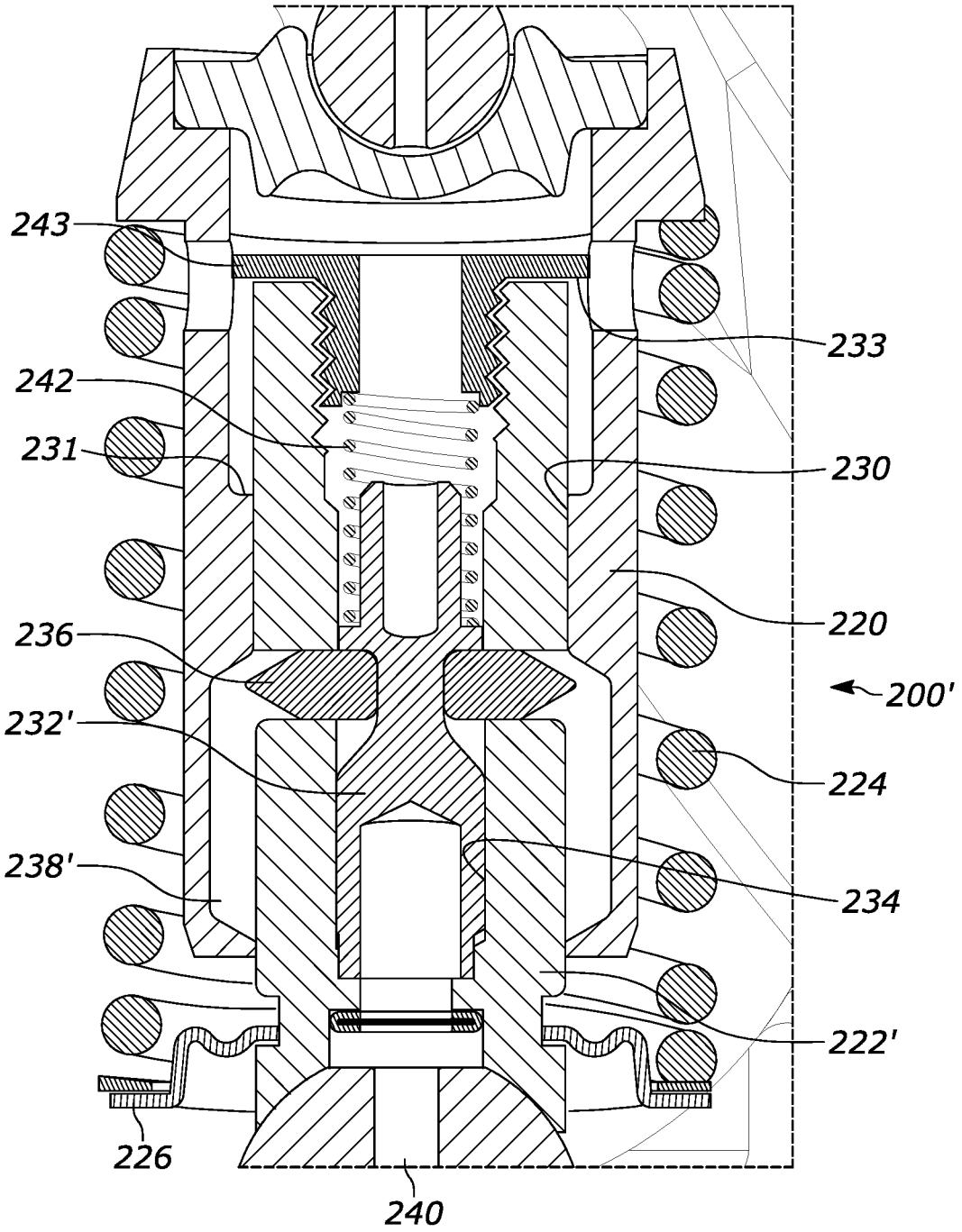
FIG. 2A is a cross-sectional illustration of an alternative example of a lost motion component that may be used to implement the various embodiments described herein.

FIG. 2A illustrates an example of a normally unlocked lost motion component 200'. Elements having like reference numerals in FIGS. 2 and 2A are substantially similar in structure and function, whereas reference numerals including a prime symbol (') in FIG. 2A refer to elements that are characterized by differing structure and/or function relative to counterparts illustrated in FIG. 2, as described below. In the embodiment illustrated in FIG. 2A, the lost motion component 200' once again includes a housing 220 having a longitudinal bore 230 formed therein, and a plunger 222' slidably disposed in the bore 230. Likewise, an inner plunger 232' is disposed in a bore 234' formed in the plunger 222' and biased out of the bore 234' by an inner plunger spring 242 disposed between the inner plunger 232' and a plunger cap 243.

However, in this case, the inner plunger 232' is structured essentially opposite the inner plunger 232 shown in FIG. 2 such that, in the absence of hydraulic control applied to the inner plunger 232', the inner plunger spring 242 biases the inner plunger 232' into position such that the wedges 236 do not radially extend out of openings formed in the plunger 220 and therefore do not engage the outer annular recess 238', thereby effectively unlocking the plunger 222' relative to the housing 220 and permitting the plunger 222' to slide freely within its bore 230, subject to the bias provided by the plunger spring 224. In this unlocked state, any valve actuation motions applied to the lost motion component 200' will cause the plunger 222' to reciprocate in its bore 230. In the illustrated embodiment, the plunger 222' is configured such that travel of the plunger 222' within its bore 230 permits the plunger 222' to "bottom out," i.e., to make contact, in this case, between the plunger cap 243 and the closed end of the bore 230. In this manner, the lost motion component 200' is able to prevent overextension of any hydraulic lash adjuster disposed in the same valve train as the lost motion component 200'. Additionally, such travel limiting of the plunger 222' permits application of a "failsafe" auxiliary valve actuation motion, e.g., a high lift braking gas recirculation (BGR) motion, in the event of failure of the locking mechanism 210. Once again, stroke limiting may be provided in the lost motion component 200' so as to prevent overextension of the housing 220 and plunger 222' away from each other, which could otherwise cause collapse of a hydraulic lash adjuster. For example, as shown in FIG. 2A, the plunger cap 243 may be configured such that it includes a radially extending lip or flange 233 configured to engage the shoulder 231 formed in the bore 230, thereby preventing overextension of the plunger 222' out of the bore 230.

On the other hand, provision of hydraulic fluid to the input-received end (bottommost surface as shown in FIG. 2A) of the inner plunger 232' sufficiently pressurized to overcome the bias of the inner plunger spring 242, causes the inner plunger 232' to translate within the bore 234 such that the wedges 236 are forced to extend and engage with the outer recess 238', thereby effectively locking the plunger 222' relative to the housing 220. In this locked state, valve actuation motions applied to the lost motion component 200' will cause the plunger 222' to engage the housing 220 thereby transmitting such valve actuation motions.

A further feature of the housing 220 is that the annular outer recess 238' has a longitudinal extent such that the plunger 222' is permitted to slide within its bore 230 even when the lost motion component 200' is in its locked/motion conveying state. This configuration of the outer recess 238' accommodates separation between the first-input rockers 112, 142 and the output rocker 116.

Figure 3:
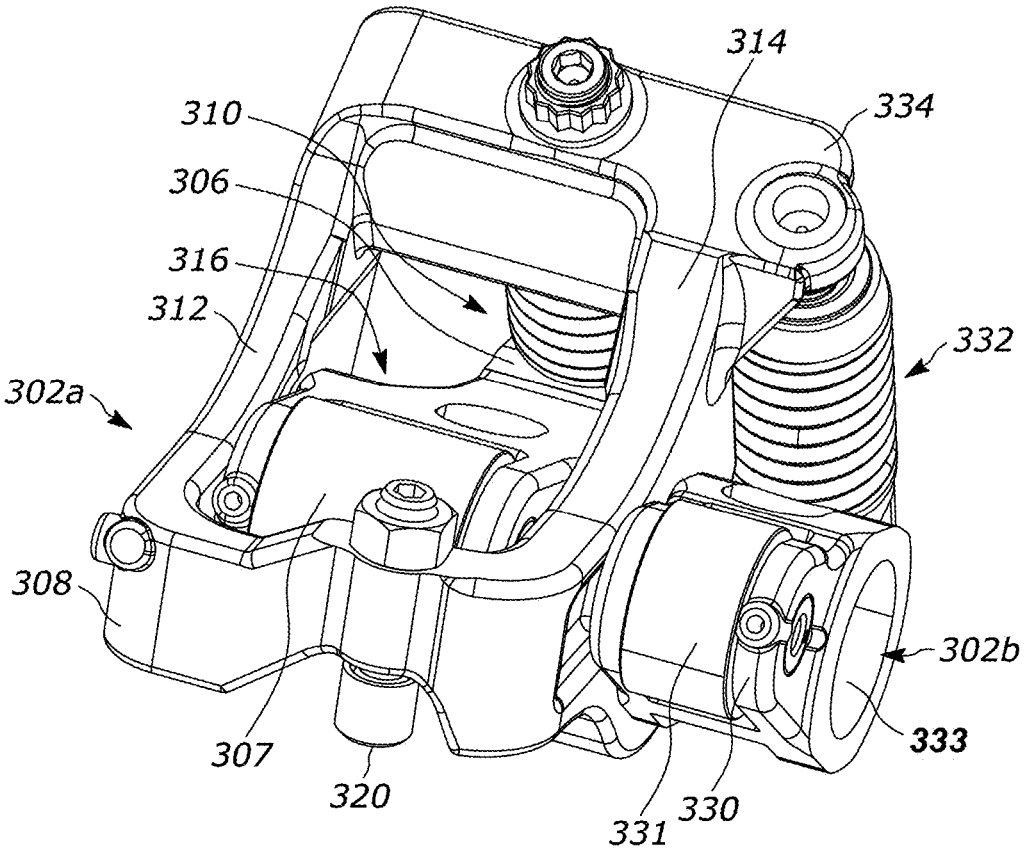
FIGS. 3 and 4 illustrate a first implementation of a valve actuation system in accordance with the embodiment of FIG. 1.
Figure 4:
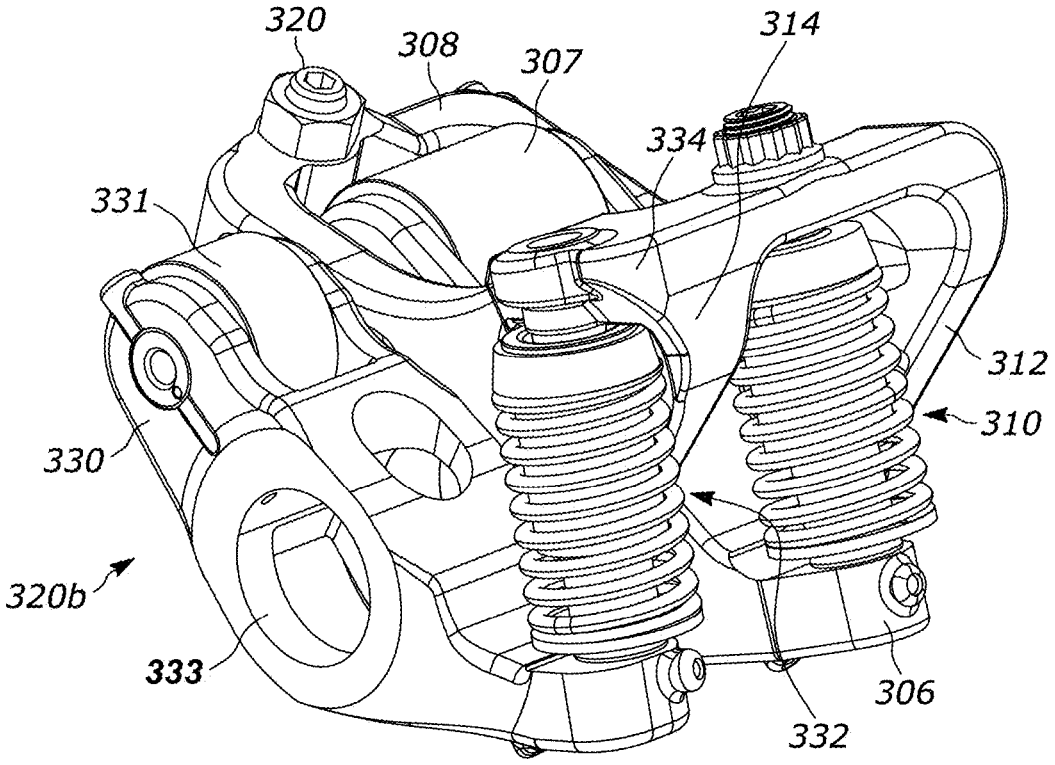

Referring now to FIGS. 3 and 4, a first implementation of a valve actuation system in accordance with FIG. 1 is shown. In particular, the illustrated implementation includes a first rocker assembly 302*a* and a second rocker assembly 302*b*. The first rocker assembly 302*a* comprises a first input rocker 306, an output rocker 308 and a first lost motion component 310. The first input rocker 306 comprises a roller bearing 307 configured to receive valve actuation motions from a first valve actuation motion source, e.g., a cam disposed on an overhead camshaft (not shown), at a motion receiving end of the first input rocker 306. The first input rocker 306 is, at a motion imparting end thereof, operatively connected to an input end of the first lost motion component 310. In turn, the first lost motion component 310 is operatively connected, at an output end thereof, to a motion receiving end of the output rocker 308. In an embodiment, the first input rocker 306 may include one or more hydraulic passages (as known in the art; not shown) configured to receive hydraulic fluid from, for example, a rocker shaft (not shown) and route such hydraulic fluid to the first lost motion component 310 (thereby controlling operation thereof as described above relative to FIG. 2).

The output rocker 308 comprises, in this embodiment, first and second lateral arms 312, 314 that define a central opening 316 therebetween, which central opening 316 is configured to receive the first input rocker 306, thereby encompassing or embracing the first input rocker 306 between the first and second lateral arms 312, 314. The output rocker 308 also comprises, in this embodiment and at a motion imparting end thereof, an adjustable lash screw and swivel assembly 320 configured to engage the engine valve or valve bridge, if provided (neither shown). Alternatively, an HLA may be provided in place of the illustrated lash screw and swivel assembly 320. Where an HLA is provided, the output rocker 308 may also comprise one or more internal hydraulic passages (as known in the art; not shown) configured to receive hydraulic fluid from, for example, a rocker shaft (not shown) and route such hydraulic fluid to the HLA.

Although not visible in FIGS. 3 and 4, the output rocker 308 as well as the first input rocker 306 each includes a rocker shaft bore. In the case of the output rocker 308, the rocker shaft bore is formed in both the first and second lateral arms 312, 314 configured to receive the rocker shaft. Configured in this manner, both the first input rocker 306 and the output rocker 308 are able to reciprocate about the rocker shaft in response to valve actuation motions applied to the first input rocker 306 (and, via the first lost motion component 310, to the output rocker 308) or, as explained in further detail below, the output rocker 308 reciprocates about the rocker shaft in response to valve actuation motions applied to the output rocker 308 via the second rocker assembly 302*b*.

The second rocker assembly 302*b*, in this implementation, comprises a second input rocker 330 and a second lost motion component 332. The second input rocker 330 is a shaft-mounted, center-pivot rocker comprising a rocker shaft bore 333 configured to receive the rocker shaft. As illustrated, the second rocker assembly 302*b* resides adjacent to the first rocker assembly 302*a* and, more particularly, the second input rocker 330 is disposed on the rocker shaft adjacent to the output rocker 308. The second input rocker 330 also comprises, at a motion receiving end thereof, a roller bearing 331 configured to receive valve actuation motions from a second valve actuation motion source, e.g., a cam disposed on the overhead camshaft. The second input rocker 330 is, at a motion imparting end thereof, operatively connected to an input end of the second lost motion component 332. In turn, the second lost motion component 332 is operatively connected, at an output end thereof, to a motion receiving extension 334 of the output rocker 308. As illustrated, the motion receiving extension 334 extends axially (relative to the rocker shaft) toward the adjacent second rocker assembly 302*b* such that it overlaps with the output end of the second lost motion component 332. In an embodiment, the second input rocker 330 may include one or more hydraulic passages (as known in the art; not shown) configured to receive hydraulic fluid from, for example, a rocker shaft (not shown) and route such hydraulic fluid to the second lost motion component 332 (thereby controlling operation thereof as described above relative to FIG. 2). Configured in this manner, the second input rocker 330 is able to reciprocate about the rocker shaft in response to valve actuation motions applied by the second valve actuation motion source and convey such valve actuation motions to the output rocker 308.

It is noted that, from the point of view of the first and second valve actuation motion sources (applying valve actuation motions to the first and second input rockers 306, 330) and the engine valve(s) (receiving valve actuation motions from the output rocker 308), the first and second rocker assemblies 302*a*, 302*b* operate like Type II or end pivot rocker arms, akin to so called finger followers as known in the art. However, to achieve such operation the first rocker assembly 302*a* relies on the combination of two Type III or center pivot rocker arms (the first input rocker 306 and the output rocker 308) in conjunction with the first lost motion assembly 310. Similarly, the second rocker assembly 302*b* also relies on the combination of two Type III or center pivot rocker arms (the second input rocker 330 and the output rocker 308) in conjunction with the second lost motion assembly 332. That is, both the first and second rocker assemblies 302*a*, 302*b* may be thought of as a quasi- or compound-Type II rockers based on a combination of constituent Type III rockers.

Figure 5:
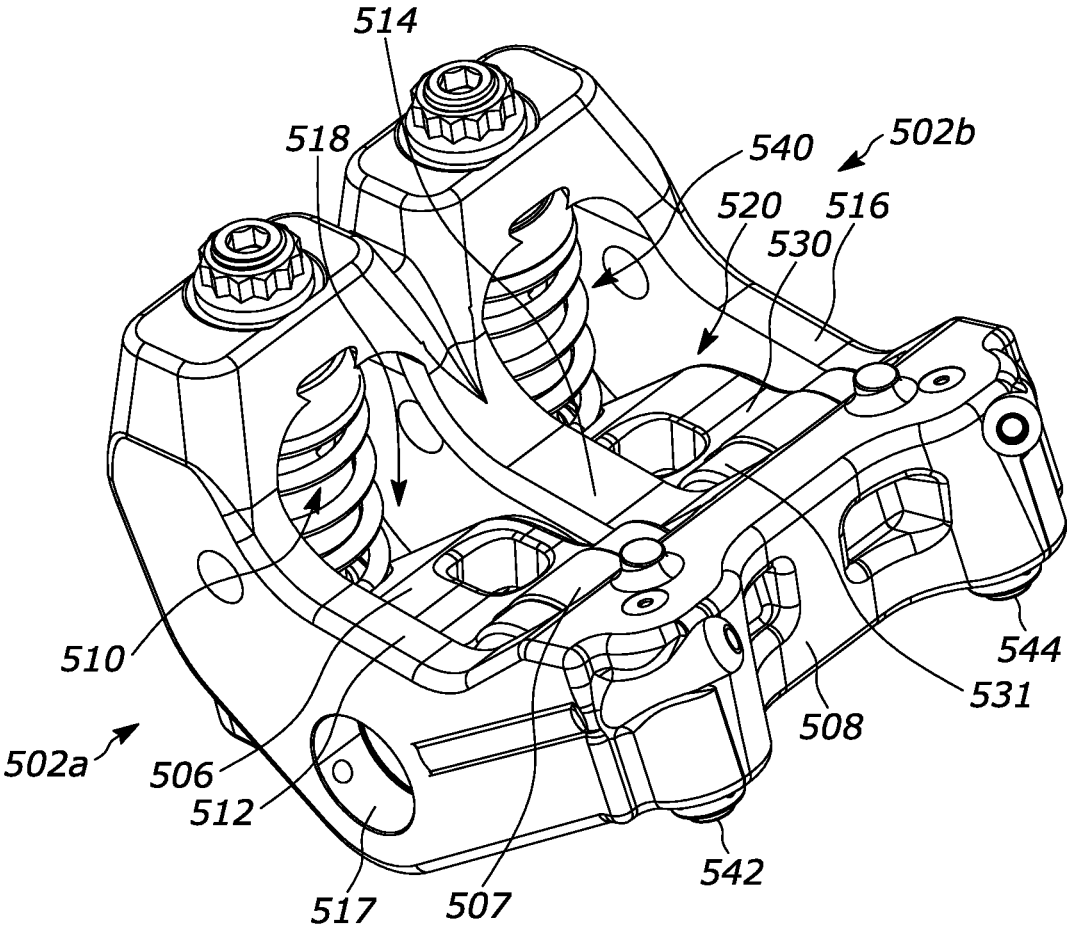
FIGS. 5 and 6 illustrate a second implementation of a valve actuation system in accordance with the embodiment of FIG. 1.
Figure 6:
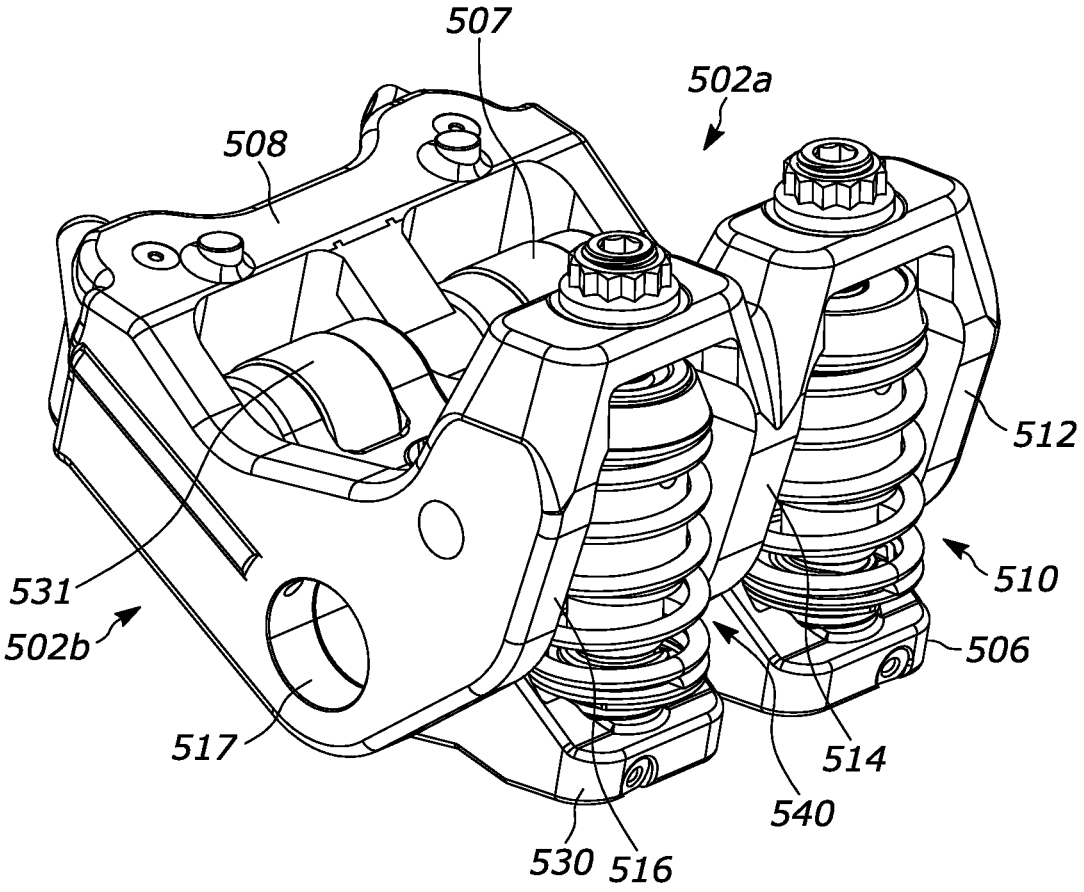

Referring now to FIGS. 5 and 6, a second implementation of a valve actuation system in accordance with FIG. 1 is shown. In keeping with FIG. 1, the implementation shown in FIGS. 5 and 6 includes a first rocker assembly 502*a* and a second rocker assembly 502*b*. The first rocker assembly 502*a* is essentially identical in function and construction to the first rocker assembly 302*a* illustrated in FIGS. 3-4. That is, the first rocker assembly 502*a* comprises a first input rocker 506 (having a roller bearing 507 at a motion receiving end thereof) operatively connected to a first lost motion assembly 510 that, in turn, is operatively connected to an output rocker 508. Additionally, the second rocker assembly 502*b* includes a second input rocker 530 (having a roller bearing 531 at a motion receiving end thereof) operatively connected to a second lost motion assembly 540 that, in turn, is also operatively connected to the output rocker 508. In an embodiment, the first and second input rockers 506, 530 each may include one or more hydraulic passages (not shown) configured to receive hydraulic fluid from, for example, a rocker shaft (not shown) and route such hydraulic fluid to the first and second lost motion components 510, 540 (thereby controlling operation thereof as described above relative to FIG. 2).

However, the implementation of FIGS. 5 and 6 differs from that of FIGS. 3 and 4 in that an output rocker 508 is a unitary body having first, second and third arms 512, 514, 516 defining a first central opening 518 (between the first and second arm 512, 514) and a second central opening 520 (between the second and third arms 514, 516). The first central opening 518 is configured to receive the first input rocker 506 and the second central opening 520 is configured to receive the second input rocker 530 such that the first and second central openings 518, 520 encompass or embrace the respective first and second input rockers 506, 530. Each of the multiple arms 512, 514, 516 has a rocker shaft bore 517 formed therein and configured to receive the rocker shaft. Additionally, though not illustrated in FIGS. 5 and 6, the first and second input rockers 506, 530 also include rocker shaft bores configured to receive the rocker shaft. Configured in this manner, the implementation of FIGS. 5 and 6 can be used to provide single input source switching (i.e., switching between the first motion source 120 and the second motion source 130) for a single output, or application of both sources to the single output.

Unlike the implementation of FIGS. 3 and 4, in which the output rocker 508 included a single lash screw and swivel assembly to interface with the engine valve(s), the output rocker of FIGS. 5 and 6 comprises hydraulic lash adjusters 542, 544 disposed on a motion imparting end of the output rocker 508 and configured to engage a corresponding pair of engine valves. In this case, the output rocker 508 is configured to include the hydraulic passages (as known in the art; not shown) needed to operate the hydraulic lash adjusters 542, 544. Nonetheless, it is understood that the HLAs 542, 544 could be replaced with suitable lash screw and swivel assemblies as desired.

While the various embodiments in accordance with the instant disclosure have been described in conjunction with specific implementations thereof, it is evident that many alternatives, modifications and variations will be apparent to those skilled in the art. In the various embodiments described herein, the input rockers and output rocker are depicted as pivoting about a rocker shaft. However, the instant disclosure need not be limited in this regard, and it is understood that pivoting arrangements other than about a rocker shaft may be equally employed. For example, the input rockers and output rocker may respectively pivot about different shafts. Further, such shafts could even be mounted on other rocker arms or on separate shaft pedestals.

Accordingly, the preferred embodiments of the invention as set forth herein are intended to be illustrative only and not limiting so long as the variations thereof come within the scope of the appended claims and their equivalents.

What is claimed is:

1. A system for actuating at least one engine valve associated with a cylinder of an internal combustion engine, the system comprising:

an output rocker operatively connected to the at least one engine valve;

a first rocker assembly operatively connected to a first valve actuation motion source, the first rocker assembly comprising:

a first input rocker configured to receive first valve actuation motions from the first valve actuation motion source, and a first lost motion component arranged in series between the first input rocker and the output rocker, the first lost motion component configured to be switched between a motion absorbing state in which conveyance of the first valve actuation motions from the first input rocker to the output rocker is prevented, and a motion conveying state in which conveyance of the first valve actuation motions from the first input rocker to the output rocker is enabled; and a second rocker assembly operatively connected to a second valve actuation motion source, the second rocker assembly comprising:

a second input rocker configured to receive second valve actuation motions from the second valve actuation motion source, and a second lost motion component arranged in series between the second input rocker and the output rocker, the second lost motion component configured to be switched between a motion absorbing state in which conveyance of the second valve actuation motions from the second input rocker to the output rocker is prevented, and a motion conveying state in which conveyance of the second valve actuation motions from the second input rocker to the output rocker is enabled.

2. The system of claim 1, wherein the output rocker includes at least one hydraulic lash adjuster.

3. The system of claim 1, wherein the at least one engine valve includes at least two engine valves associated with the cylinder such that the output rocker is operatively connected to the at least two engine valves.

4. The system of claim 3, wherein the output rocker is operatively connected to the at least two engine valves via a valve bridge.

5. The system of claim 1, wherein the first input rocker and the output rocker each include a shaft-mounted Type III rocker.

6. The system of claim 5, wherein the first rocker assembly cooperates with the output rocker so as to operate as a compound-Type II rocker.

7. The system of claim 1, wherein the second input rocker and the output rocker each include a shaft-mounted Type III rocker.

8. The system of claim 7, wherein the second rocker assembly cooperates with the output rocker so as to operate as a compound-Type II rocker.

9. The system of claim 1, wherein the output rocker includes a first arm and a second arm collectively defining a first central opening configured to receive the first input rocker.

10. The system of claim 9, wherein the output rocker further includes a third arm arranged such that the second arm and third arm collectively define a second central opening configured to receive the second input rocker.

11. The system of claim 1, wherein the first lost motion component and the second lost motion component each include a hydraulically controlled locking mechanism.

12. The system of claim 1, wherein the first lost motion component includes a first spring configured to:

bias the first input rocker toward the first valve actuation motion source, and bias the output rocker toward the at least one engine valve.

13. The system of claim 1, wherein the second lost motion component includes a second spring configured to:

bias the second input rocker toward the second valve actuation motion source, and bias the output rocker toward the at least one engine valve.

14. The system of claim 1, wherein the first lost motion component is further configured to provide a failsafe lift.

* * * * *